US009010145B2

(12) United States Patent
Lim et al.

(10) Patent No.: US 9,010,145 B2
(45) Date of Patent: Apr. 21, 2015

(54) REFRIGERATOR

(75) Inventors: Jae Hoon Lim, Suwon-si (KR); Gi Joong Jeong, Gwangju (KR); Sinn Bong Yoon, Gwangju (KR); Woo Yeol Yoo, Gwangju (KR); Jong Eun Chae, Gwangju (KR); Sun Keun Lee, Gwangju (KR); Yun Ho Yang, Yongin-si (KR); Sang Woon Jeon, Namyangju-si (KR); Jae Moon Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1035 days.

(21) Appl. No.: 12/801,104

(22) Filed: May 21, 2010

(65) Prior Publication Data

US 2010/0300137 A1 Dec. 2, 2010

(30) Foreign Application Priority Data

Jun. 1, 2009 (KR) ..... 10-2009-0048272
Nov. 10, 2009 (KR) ..... 10-2009-0108025

(51) Int. Cl.
*F25D 11/02* (2006.01)
*F25D 17/06* (2006.01)
(Continued)

(52) U.S. Cl.
CPC ..... *F25D 17/065* (2013.01); *F25C 5/005* (2013.01); *F25C 5/046* (2013.01); *F25C 2400/10* (2013.01); *F25D 2317/061* (2013.01); *F25D 2317/063* (2013.01); *F25D 2317/0666* (2013.01); *F25D 2317/067* (2013.01); *F25D 2317/0671* (2013.01)

(58) Field of Classification Search
USPC ..... 62/417, 333, 441, 442, 419, 425
See application file for complete search history.

(56) References Cited

U.S. PATENT DOCUMENTS 3,020,733 A * 2/1962 Hubacker et al. ..... 62/414
4,296,611 A * 10/1981 Griffin et al. ..... 62/89
4,509,335 A * 4/1985 Griffin et al. ..... 62/77
(Continued)

FOREIGN PATENT DOCUMENTS

JP 2004-293804 10/2004
JP 2004293804 A * 10/2004
(Continued)

OTHER PUBLICATIONS

Chinese Office Action issued Sep. 23, 2013 in corresponding Chinese Patent Application No. 201010193872.6.

*Primary Examiner* — Mohammad M Ali
*Assistant Examiner* — Raheena Rehman
(74) *Attorney, Agent, or Firm* — Staas & Halsey LLP

(57) ABSTRACT

A refrigerator having an intermediate storage compartment, which has an improved structure of a return flow passage to return cold air from the intermediate storage compartment. The refrigerator includes a first evaporator to supply cold air to an upper storage compartment, a second evaporator to supply cold air to a lower storage compartment, a cold air supply duct to supply cold air generated at the second evaporator to an intermediate storage compartment, and a curved section formed at a top of the intermediate storage compartment to uniformly distribute the cold air supplied via the cold air supply duct in the intermediate storage compartment. The refrigerator also includes a cold air return duct to return cold air from the intermediate storage compartment, and an ice-making cold air return duct to return cold air from an ice maker. The cold air return duct is joined with the ice-making cold air return duct.

25 Claims, 12 Drawing Sheets

(51) Int. Cl.
*F25C 5/00* (2006.01)
*F25C 5/04* (2006.01)

(56) References Cited

U.S. PATENT DOCUMENTS 5,732,561 A * 3/1998 Kim ..... 62/89
5,735,138 A * 4/1998 Park et al. ..... 62/455
5,755,112 A * 5/1998 Kang ..... 62/407
5,778,688 A * 7/1998 Park et al. ..... 62/89
5,799,496 A * 9/1998 Park et al. ..... 62/89
6,029,460 A * 2/2000 Ji ..... 62/89
6,055,826 A * 5/2000 Hiraoka et al. ..... 62/408
2006/0260347 A1* 11/2006 Coulter et al. ..... 62/344
2008/0016889 A1* 1/2008 Jung ..... 62/187
2008/0034780 A1* 2/2008 Lim et al. ..... 62/353
2008/0134708 A1* 6/2008 Lee et al. ..... 62/340
2008/0173040 A1* 7/2008 Lim et al. ..... 62/354
2008/0307823 A1* 12/2008 Lee et al. ..... 62/441
2009/0133432 A1* 5/2009 Lee et al. ..... 62/441

FOREIGN PATENT DOCUMENTS

JP 2007-327718 12/2007
JP 2008-106993 5/2008
KR 10-1999-0031033 5/1999

* cited by examiner

REFRIGERATOR

CROSS-REFERENCE TO RELATED APPLICATIONS

This application claims the benefit of Korean Patent Application Nos. 2009-48272 and 2009-108025, respectively filed on Jun. 1, 2009 and Nov. 10, 2009 in the Korean Intellectual Property Office, the disclosures of which are incorporated herein by reference.

BACKGROUND

1. Field

Embodiments relate to a refrigerator, and, more particularly, to a refrigerator having an intermediate storage compartment.

2. Description of the Related Art

Refrigerators are adapted to maintain food in a fresh state for a prolonged period of time by supplying cold air generated through a refrigeration cycle to a storage compartment in which the food is stored.

Generally, such a refrigerator includes a cabinet formed with an upper storage compartment and a lower storage compartment. The upper storage compartment is opened or closed by a hinged door pivotally coupled to the cabinet. A drawer is mounted to the lower storage compartment such that the drawer can be extended from or retracted into the lower storage compartment.

SUMMARY

Therefore, it is an aspect to provide a refrigerator having an intermediate storage compartment, which is capable of uniformly distributing cold air into the intermediate storage compartment.

Another aspect is to provide a refrigerator having an intermediate storage compartment, which is capable of supplying cold air from an evaporator for a freezing compartment to the intermediate storage compartment.

Another aspect is to provide a refrigerator having an intermediate storage compartment, which has an improved structure of a return flow passage to return cold air.

Additional aspects will be set forth in part in the description which follows and, in part, will be apparent from the description, or may be learned by practice of the invention.

In accordance with one aspect, a refrigerator includes a cabinet formed with an upper storage compartment, an intermediate storage compartment, and a lower storage compartment, which are partitioned from one another by insulated partition walls, a first evaporator to supply cold air to the upper storage compartment, a second evaporator to supply cold air to the lower storage compartment, a cold air supplier arranged beneath a rear wall of the upper storage compartment, to supply cold air to the intermediate storage compartment, and a cold air supply duct to supply cold air generated at the second evaporator to the cold air supplier.

The first evaporator may be arranged at a rear side of the upper storage compartment. The second evaporator may be arranged at a rear side of the lower storage compartment.

The cold air supplier may include a circulating fan to blow cold air to an outlet provided at a rear wall of the intermediate storage compartment, and a cold air regulator to regulate an amount of cold air to be supplied to the intermediate storage compartment.

The refrigerator may further include a cold air diffuser formed at a top of the intermediate storage compartment, the cold air diffuser having a curved structure to guide the cold air discharged through the cold air supplier.

The cold air diffuser may include a first curved portion arranged at an entrance of the intermediate storage compartment while being downwardly protruded, a second curved portion extending inwardly from the first curved portion while being sharply inclined in an upward direction, and a third curved portion extending inwardly from the second curved portion while being gently inclined in a downward direction.

The refrigerator may further include an ice maker arranged in the upper storage compartment, to produce ice, an ice-making cold air supply duct to supply cold air from the second evaporator to the ice maker, and an ice-making cold air return duct to return the cold air from the ice maker to the second evaporator. The ice-making cold air return duct may be integrally formed with a cold air return duct partitioned from the ice-making cold air return duct by an insulated partition wall, to return the cold air used to cool the intermediate storage compartment to the second evaporator.

The intermediate storage compartment may include a cold air inlet arranged at one side of a rear wall of the intermediate storage compartment, to suck cold air used to cool the intermediate storage compartment such that the sucked cold air is returned to the second evaporator, and an introduction preventing cap arranged to cover an upper portion of the cold air inlet, the introduction preventing cap functioning to prevent cold air supplied to the intermediate storage compartment from being directly introduced into the cold air inlet.

The intermediate storage compartment may include a cold air diffusion passage formed in a top wall of the intermediate storage compartment, to move cold air discharged through the cold air supply duct, and at least one cold air outlet formed at the cold air discharge passage, to discharge cold air into the intermediate storage compartment.

The at least one cold air outlet may include cold air outlets concentratedly arranged near a front portion of the intermediate storage compartment.

In accordance with another aspect, a refrigerator, which includes an upper storage compartment, an intermediate storage compartment, and a lower storage compartment, which are partitioned from one another by insulated partition walls, a first evaporator arranged at a rear side of the upper storage compartment, to supply cold air to the upper storage compartment, and a second evaporator arranged at a rear side of the lower storage compartment, to supply cold air to the lower storage compartment, further includes a cold air supplier including a cold air supply duct to supply cold air from the second evaporator to the intermediate storage compartment, a cold air return duct to return the cold air used to cool the intermediate storage compartment to the second evaporator, a circulating fan to discharge cold air supplied from the cold air supply duct into the intermediate storage compartment, and a cold air regulator to regulate an amount of cold air discharged into the intermediate storage compartment, wherein the cold air supplier is arranged beneath a rear wall of the upper storage compartment, to supply cold air to an outlet formed at one side of the intermediate storage compartment.

The intermediate storage compartment may include a cold air inlet arranged at a rear side of the intermediate storage compartment, to suck cold air used to cool the intermediate storage compartment such that the sucked cold air is returned to the second evaporator, and an introduction preventing cap arranged to cover an upper portion of the cold air inlet, the introduction preventing cap functioning to prevent cold air discharged from the outlet from being directly introduced into the cold air inlet.

The refrigerator may further include an ice maker arranged in the upper storage compartment, an ice-making cold air supply duct to supply cold air from the second evaporator to the ice maker, and an ice-making cold air return duct to return the cold air from the ice maker to the second evaporator. The cold air return duct to return cold air used to cool the intermediate storage compartment may be joined with the ice-making cold air return duct.

An insulated partition wall may be arranged between the cold air return duct and the ice-making cold air return duct, to insulate the cold air return duct and the ice-making cold air return duct from each other.

The refrigerator may further include a cold air diffuser formed at a top of the intermediate storage compartment, the cold air diffuser having a curved structure to allow the cold air discharged through the outlet to reach a front side of the intermediate storage compartment.

The cold air diffuser may include a first curved portion arranged at an entrance of the intermediate storage compartment while being downwardly protruded, a second curved portion extending inwardly from the first curved portion while being sharply inclined in an upward direction, and a third curved portion extending inwardly from the second curved portion while being gently inclined in a downward direction.

The intermediate storage compartment may include a cold air diffusion passage formed in a top wall of the intermediate storage compartment, to guide cold air supplied through the cold air supplier such that the cold air is discharged through the outlet.

The intermediate storage compartment may further include at least one cold air outlet formed through a top of the intermediate storage compartment, to communicate the cold air diffusion passage and the intermediate storage compartment.

The cold air diffusion passage may be surrounded by an insulator.

In accordance with another aspect, a refrigerator, which includes an upper storage compartment, an intermediate storage compartment, and a lower storage compartment, which are partitioned from one another by insulated partition walls, further includes a first evaporator to supply cold air to the upper storage compartment, a second evaporator arranged at a rear side of the lower storage compartment, to supply cold air to the lower storage compartment, a cold air supply duct extending from the second evaporator to a rear side of the intermediate storage compartment, to supply cold air generated at the second evaporator to the intermediate storage compartment, a cold air supplier arranged beneath a rear wall of the upper storage compartment, to supply cold air supplied from the cold air supply duct to the intermediate storage compartment, and a cold air diffuser formed at a top of the intermediate storage compartment, the cold air diffuser having a curved structure to allow the cold air supplied through the cold air supplier to be diffused after reaching a front side of the intermediate storage compartment.

The cold air diffuser may include a first curved portion arranged at an entrance of the intermediate storage compartment while being downwardly protruded, a second curved portion extending inwardly from the first curved portion while being sharply inclined in an upward direction, and a third curved portion extending inwardly from the second curved portion while being gently inclined in a downward direction.

The refrigerator may further include a cold air return duct to return cold air from the intermediate storage compartment, and an ice-making cold air return duct to return cold air from an ice maker, which produces ice. The cold air return duct may be joined with the ice-making cold air return duct. An insulated partition wall may be arranged between the cold air return duct and the ice-making cold air return duct, to insulate the cold air return duct and the ice-making cold air return duct from each other.

The intermediate storage compartment may include a cold air inlet arranged at one side of a rear portion of the intermediate storage compartment, to suck cold air from the intermediate storage compartment, the cold air inlet communicating with the cold air return duct, and an introduction preventing cap arranged to cover an upper portion of the cold air inlet, the introduction preventing cap functioning to prevent cold air discharged into the intermediate storage compartment from being directly introduced into the cold air inlet.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Hereinafter, a refrigerator according to an exemplary embodiment will be described with reference to the accompanying drawings.

Figure 1:
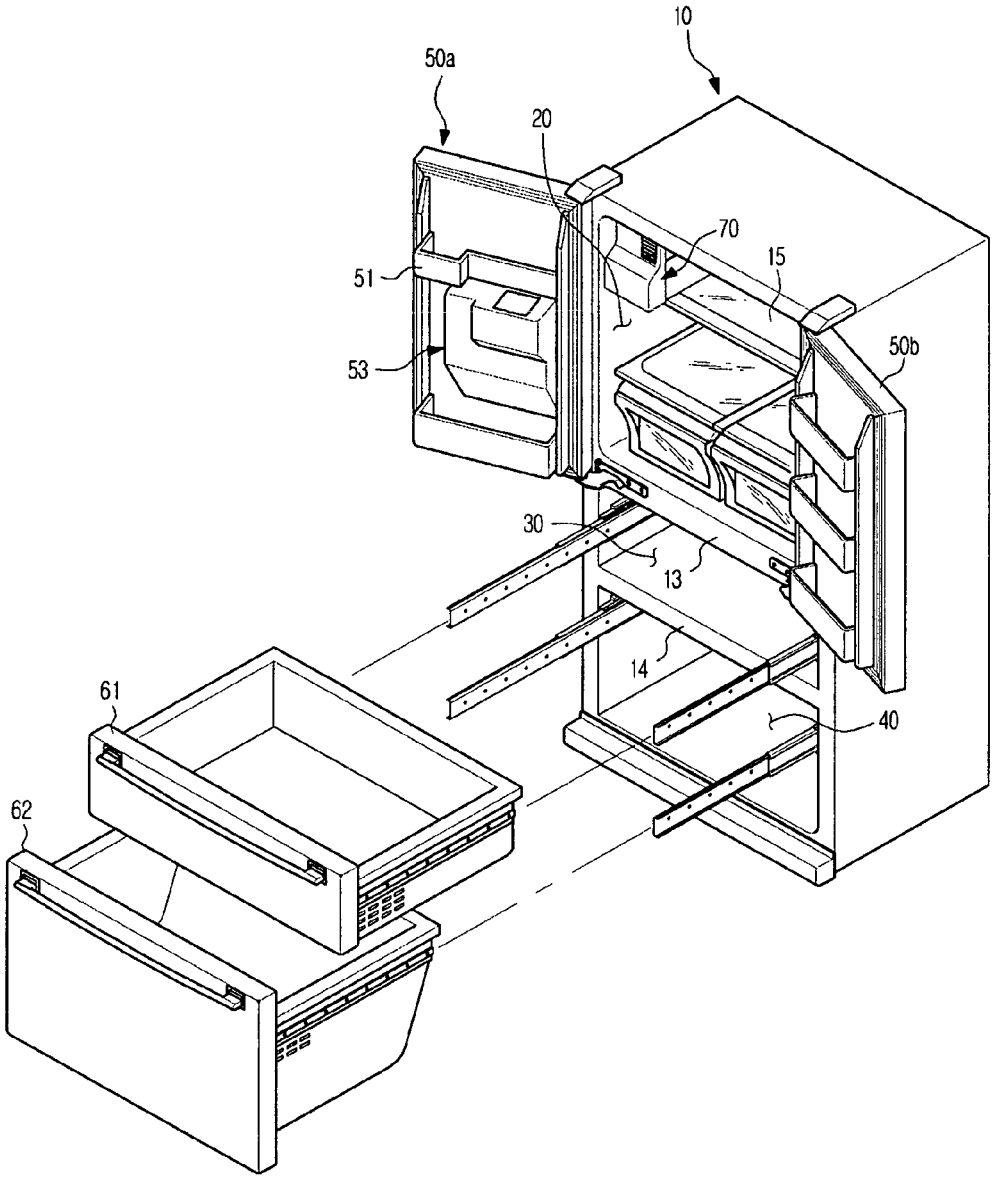
FIG. 1 is a perspective view illustrating an outer appearance of a refrigerator according to an exemplary embodiment in a state in which a refrigerating compartment door is opened.
Figure 2:
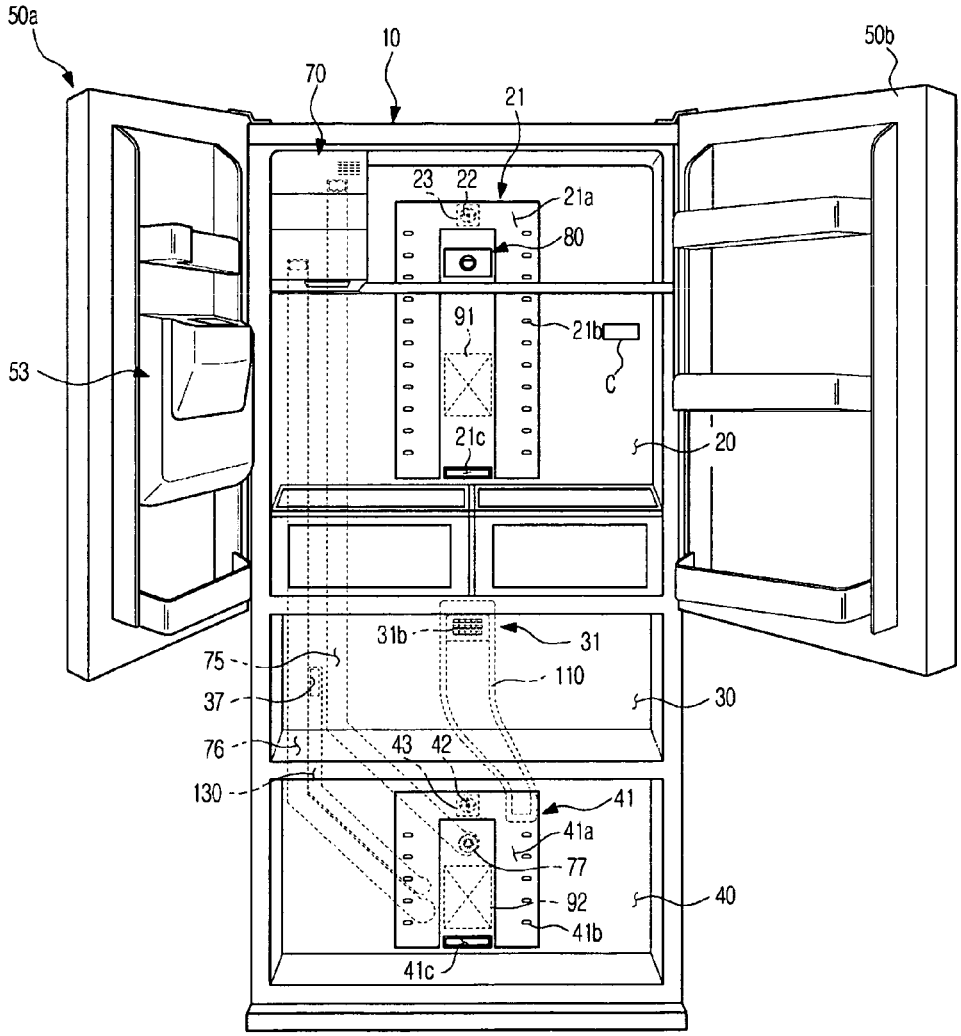
FIG. 2 is a front view of the refrigerator shown in FIG. 1.
Figure 3:
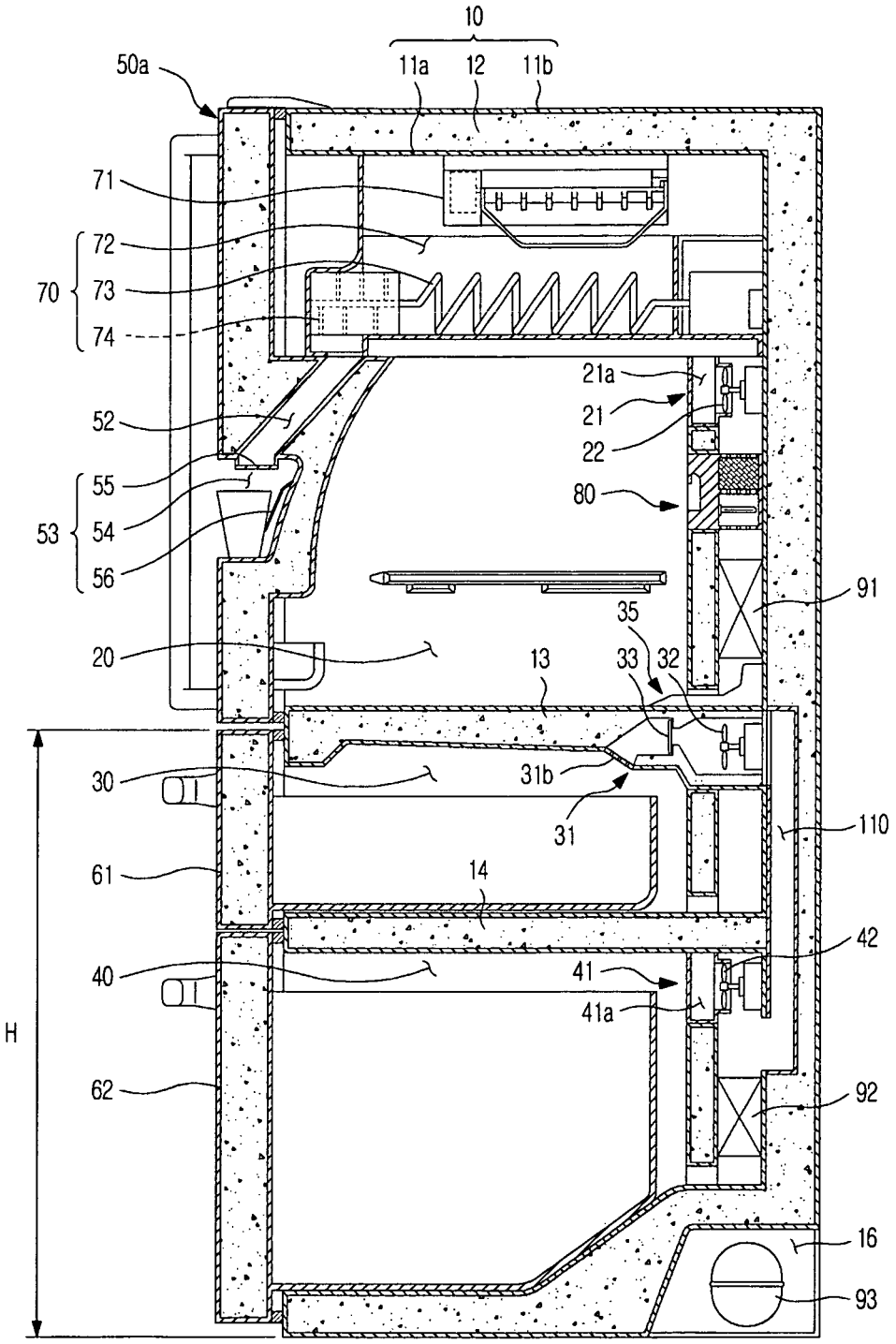
FIG. 3 is a sectional view of the refrigerator shown in FIG. 1 in a state in which the refrigerating compartment door, a first drawer, and a second drawer are closed.

FIG. 1 is a perspective view illustrating an outer appearance of a refrigerator according to an exemplary embodiment in a state in which a refrigerating compartment door is opened. FIG. 2 is a front view of the refrigerator shown in FIG. 1. FIG. 3 is a sectional view of the refrigerator shown in FIG. 1 in a state in which the refrigerating compartment door, a first drawer, and a second drawer are closed.

As shown in FIGS. 1 to 3, the refrigerator includes a cabinet 10 defined with a plurality of storage compartments, namely, a first storage compartment 20, a second storage compartment 30, and a third storage compartment 40, partitioned from one another and forwardly opened. The refrigerator also includes first and second hinged doors 50*a* and 50*b* pivotally coupled to left and right sides of the cabinet 10, to open or close the first storage compartment 20, a first drawer 61 slidably mounted to the second storage compartment 30 such that the first drawer 61 can be extended from or retracted into the second storage compartment 30, and a second drawer 62 slidably mounted to the third storage compartment 40 such that the second drawer 62 can be extended from or retracted into the third storage compartment 40. For reference, as seen in FIG. 1, the first storage compartment 20 is arranged at an upper portion of the refrigerator, the third storage compartment 40 is arranged at a lower portion of the refrigerator, and the second storage compartment 30 is arranged between the first storage compartment 20 and the third storage compartment 40.

The cabinet 10 includes an inner case 11*a*, an outer case 11*b*, and an insulator 12 filled between the inner case 11*a* and the outer case 11*b*. The cabinet 10 also includes first and second insulated partition walls 13 and 14, which partition the first storage compartment 20, second storage compartment 30, and third storage compartment 40. The first insulated partition wall 13 partitions the first storage compartment 20 and second storage compartment 30, whereas the second insulated partition wall 14 partitions the second storage compartment 30 and third storage compartment 40.

The inner case 11*a* may be bent to form outer structures of the first and second insulated partition walls 13 and 14. The insulator 12 may be filled between the inner case 11*a* and the outer case 11*b* by injecting a urethane foaming liquid between the inner case 11*a* and the outer case 11*b*, and then heating the urethane foaming liquid, to foam the urethane foaming liquid. The cabinet 10 has an integrated structure including the first and second insulated partition walls 13 and 14. Accordingly, an enhanced insulation effect is provided among the storage compartments. Reference numeral "15" designates a rack coupled to the cabinet 10, to contain food to be stored.

The first storage compartment 20, second storage compartment 30, and third storage compartment 40 defined in the cabinet 10 form independent storage spaces, respectively. The storage temperatures of the first storage compartment 20, second storage compartment 30, and third storage compartment 40 are independently controlled in accordance with respective amounts of cold air supplied to the first storage compartment 20, second storage compartment 30, and third storage compartment 40. The amounts of cold air supplied to respective storage compartments 20, 30, and 40 are controlled by a controller C, which controls a first cold air regulator 23, a second cold air regulator 33, and a third cold air regulator 43. Thus, the user may set a desired temperature of each storage compartment, in order to use the storage compartment for a particular purpose, if necessary. For example, the first storage compartment 20, second storage compartment 30, and third storage compartment 40 may be used as a refrigerating compartment, a fresh compartment, and a freezing compartment, respectively.

First and second evaporators 91 and 92, which generate cold air, are arranged at a rear wall of the cabinet 10. A machinery compartment 16 is defined at a lower rear portion of the cabinet 10. In the machinery compartment 16, electric elements including, for example, a compressor 93, etc. are installed. The compressor 93 constitutes a refrigeration cycle, together with a condenser (not shown), an expansion valve (not shown), and the evaporators 91 and 92.

At least one rack 51 is provided at an inner surface of each of the first and second hinged doors 50*a* and 50*b*. At the first hinged door 50*a*, a dispenser 53 is also provided to selectively distribute water or ice. Although not shown, an auxiliary door may be provided at least one of the first and second hinged doors 50*a* and 50*b*.

The dispenser 53 includes an outlet 54 to discharge water or ice, an opening/closing member 55 to open or close the outlet 54, and an actuating lever 56 to actuate the opening/closing member 55 and to actuate an ice maker 70 arranged at an upper portion of the first storage compartment 20.

The ice maker 70 includes an ice making unit 71 to produce ice to be supplied to the dispenser 53, an ice container 72 arranged beneath the ice making unit 71, to store the produced ice, a feeding unit 73 to feed the ice stored in the ice container 72, and an ice crushing unit 74 to crush the ice fed by the feeding unit 73. In accordance with this configuration, the ice stored in the ice container 72 is sequentially fed to an ice discharge passage 52 provided at the first hinged door 50*a*.

As described above, the first drawer 61 is arranged such that it is extended from or retracted into the second storage compartment 30 of the cabinet 10. In this case, the height H from a bottom surface of the cabinet 10 to an upper end of the first drawer 61 may be about 850 to 950 mm. Accordingly, a user of mean stature of 150 to 190 cm may easily extend or retract the first drawer 61 from or into the cabinet 10 and may easily put articles into or take articles out of a receiving space of the first drawer 61, without excessively bending his back.

A first panel 21 is mounted to a rear wall of the first storage compartment 20. The first panel 21 partitions, from the first storage compartment 20, a space where the first evaporator 91 is installed. The first panel 21 also defines a first cold air supply passage 21*a*. The first panel 21 is formed with a plurality of outlets 21*b* to distributively discharge cold air supplied through the first cold air supply passage 21*a* into the first storage compartment 20, and an inlet 21*c* to introduce cold air from the first storage compartment 20 toward the first evaporator 91. The first cold air supply passage 21*a* communicates with the outlets 21*b* at one end of the first cold air supply passage 21*a* while communicating with the inlet 21*c* at the other end of the first cold air supply passage 21*a*. A first circulating fan 22 is arranged over the first evaporator 91. By the first circulating fan 22, cold air in the first storage compartment 20 passes through the cold air supply passage 21*a* after being introduced into the inlet 21*c*. Thereafter, the cold air is discharged from the cold air supply passage 21*a* through the outlets 21*b*. The cold air is cooled by the first evaporator 91 while passing through the cold air supply passage 21*a*. The amount of cold air supplied to the first storage compartment 20 may be regulated by the first cold air regulator 23.

A cold air discharge member 31 is provided at a rear central portion of the second storage compartment 30. The cold air discharge member 31 is formed with an outlet 31*b* to distributively discharge cold air into the second storage compartment 30. A cold air inlet 37 is formed at one side of a rear portion of the second storage compartment 30, to suck cold air from the second storage compartment 30. Accordingly, cold air discharged out of the outlet 31*b* of the cold air discharge member 31 is introduced into the cold air inlet 37 after circulating the interior of the second storage compartment 30.

A cold air supplier 35 is provided in the interior of the cold air discharge member 31 beneath a rear wall of the first storage compartment 20, to supply cold air to the second storage compartment 30. The cold air supplier 35 includes a second circulating fan 32 to blow cold air to the outlet 31*b*. The second cold air regulator 33, which regulates the amount of cold air to be supplied to the second storage compartment 30, is also included in the cold air supplier 35.

The cold air supplier 35 is arranged beneath the rear wall of the first storage compartment 20 so that repair or replacement of the cold air supplier 35 may be conveniently achieved. That is, the entirety of the cold air supplier 35 may be conveniently repaired or replaced only through separation and coupling of the rear wall of the first storage compartment 20.

The second storage compartment 30 receives cold air generated at the second evaporator 92. This will be described later.

A second panel 41 is mounted to a rear wall of the third storage compartment 40. The second panel 41 partitions, from the third storage compartment 40, a space where the second evaporator 92 is installed. The second panel 41 also defines a second cold air supply passage 41*a*. The second panel 41 is formed with a plurality of outlets 41*b* to distributively discharge cold air supplied through the second cold air supply passage 41*a* into the third storage compartment 40, and an inlet 41*c* to introduce cold air from the third storage compartment 40 toward the second evaporator 92. The second cold air supply passage 41*a* communicates with the outlets 41*b* at one end of the second cold air supply passage 41*a* while communicating with the inlet 41*c* at the other end of the second cold air supply passage 41*a*. A third circulating fan 42 is arranged over the second evaporator 92. By the third circulating fan 42, cold air in the third storage compartment 40 passes around the second evaporator 92, and then returns to the third storage compartment 40. Thus, the cold air is circulated. The amount of cold air supplied to the third storage compartment 40 may be regulated by the third cold air regulator 43.

Reference numeral "75" designates an ice-making cold air supply duct, through which cold air generated at the second evaporator 92 passes, so as to be supplied to the ice maker 70. Reference numeral "76" designates an ice-making cold air return duct, through which cold air from the ice maker 70 is returned toward the second evaporator 92. In this case, the circulation of cold air may be achieved by a fourth circulating fan 77 arranged upstream from the ice-making cold air supply duct 75.

In an exemplary embodiment, the refrigerator may further include an air filter 80 to remove offensive odors or bacteria from the cold air circulating the first storage compartment 20.

As described above, the refrigerator according to the illustrated embodiment may store at least three kinds of food having different optimal storage temperatures under respective optimal low-temperature conditions because the refrigerator is provided with three storage compartments partitioned by insulated partition walls such that they are independently cooled. In particular, elongate food products such as pizza and fish may be stored at respective optimal temperatures thereof in the second and third storage compartments 30 and 40 because the first and second drawers 61 and 62 are installed at the second and third storage compartments 30 and 40, respectively. Also, taking ergonomics into consideration, the height from the bottom surface of the cabinet 10 to the upper end of the first drawer 61 is determined to be about 850 to 950 mm. Accordingly, it may be possible to provide remarkably-enhanced use convenience for the first drawer 61 to users of mean stature of 150 to 190 cm.

The amount of cold air supplied to the first storage compartment 20, the amount of cold air supplied to the second storage compartment 30, and the amount of cold air supplied to the third storage compartment 40 are regulated by the first cold air regulator 23, second cold air regulator 33, and third cold air regulator 43, respectively. In the illustrated embodiment, each of the first cold air regulator 23, second cold air regulator 33, and third cold air regulator 43 has a damper structure to regulate the opening degree of the associated cold air flow passage. Of course, each cold air regulator is not limited to such a structure. For example, the cold air regulators, which have a damper structure, may be dispensed with. In this case, the blowing fan provided in each flow passage may provide a cold air regulating function. The amount of cold air supplied by the blowing fan may be determined on the basis of an electrical load applied to the blowing fan. Of course, both the cold air regulator, which has a blowing fan structure, and the cold air regulator, which has a damper structure, may be provided.

Figure 4:
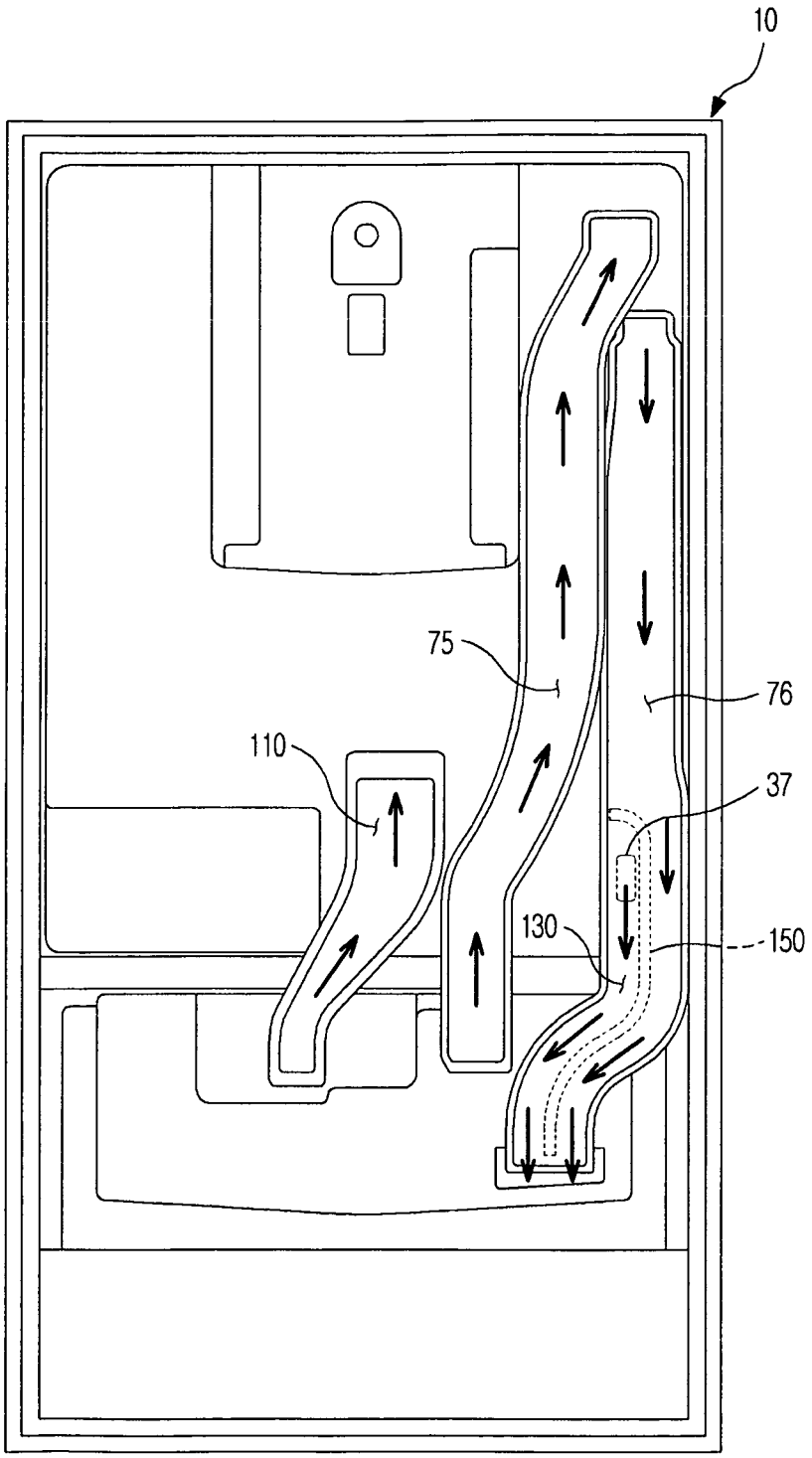
FIG. 4 is a view illustrating a flow of cold air at a rear side of the refrigerator according to an exemplary embodiment.
Figure 5:
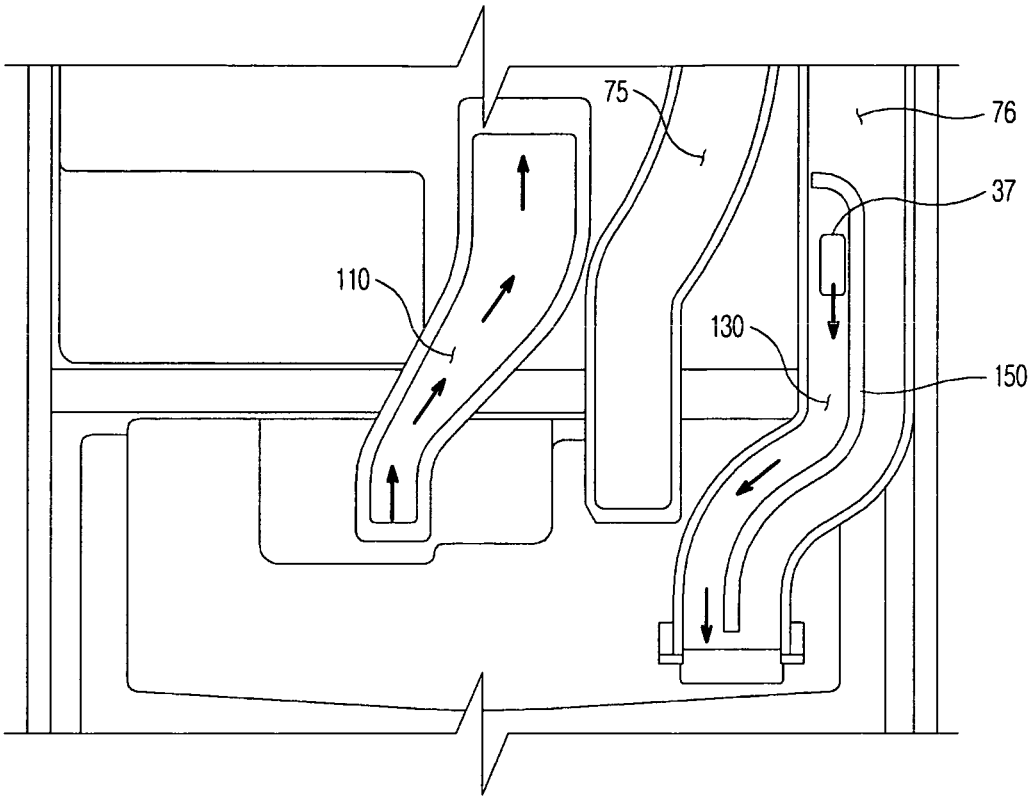
FIG. 5 is an enlarged view illustrating a flow of cold air in a second storage compartment in the case of FIG. 4.

FIG. 4 is a view illustrating a flow of cold air at the rear side of the refrigerator according to an exemplary embodiment of the present invention. FIG. 5 is an enlarged view illustrating a flow of cold air in the second storage compartment in the case of FIG. 4.

As shown in FIGS. 4 and 5, a cold air supply duct 110 is formed at a rear central portion of the refrigerator, to supply cold air generated at the second evaporator 92 to the second storage compartment 30. The cold air supply duct 110 communicates with the second cold air supply passage 41*a* at one end of the cold air supply duct 110 while communicating with the cold air discharge member 31 at the other end of the cold air supply duct 110. The cold air supply duct 110 extends from a rear side of the second evaporator 92 to a rear side of the second storage compartment 30.

A cold air return duct 130 is provided at one side of the ice-making cold air return duct 76. The cold air return duct 130 communicates with the cold air inlet 37 at one end of the cold air return duct 130 while communicating with the second cold air supply passage 41*a* at the other end of the cold air return duct 130. The cold air return duct 130 is joined with the ice-making cold air return duct 76. An insulated partition wall 150 is arranged between the cold air return duct 130 and the ice-making cold air return duct 76, in order to provide an insulating effect.

As the cold air return duct 130 partially occupies a space where the ice-making cold air return duct 76 is occupied. Accordingly, an enhancement in space utility may be achieved. By virtue of installation of the insulated partition wall 150, it may be possible to solve dewing and frosting problems incurred due to a cold air temperature difference caused by adjacent arrangement of the cold air return duct 130 and ice-making cold air return duct 76. The insulated partition wall 150 may be made of at least one of an expanded polystyrene material and a urethane material.

Thus, cold air generated at the first evaporator 91 may be supplied to the first storage compartment 20 via the first cold air supply passage 21*a*, whereas cold air generated at the second evaporator 92 is partially supplied to the third storage compartment 40 while being partially supplied to the second storage compartment 30 via the cold air supply duct 110. Of course, these cold air supply structures are illustrative, and may be varied. For example, the cold air generated at the first evaporator may be supplied to the first and second storage compartment, and the cold air generated at the second evaporator may be supplied to the third storage compartment. Also, the refrigerator may include a single evaporator. In this case, cold air generated at the single evaporator may be distributively supplied to the first, second, and third storage compartments. Alternatively, the refrigerator may include three evaporators corresponding to respective storage compartments. In this case, cold air generated at each evaporator may be supplied to the storage compartment corresponding to the evaporator.

Figure 6:
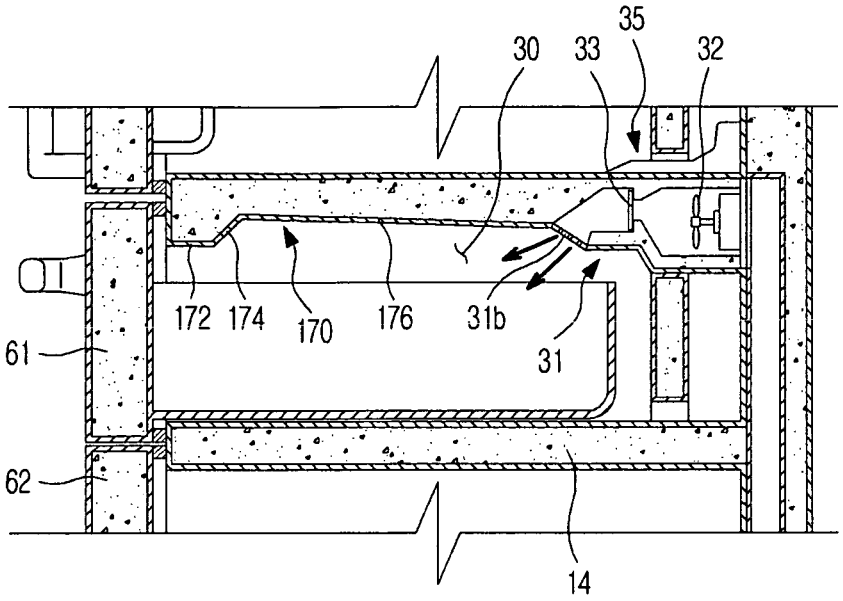
FIG. 6 is a sectional view of the second storage compartment.
Figure 7:
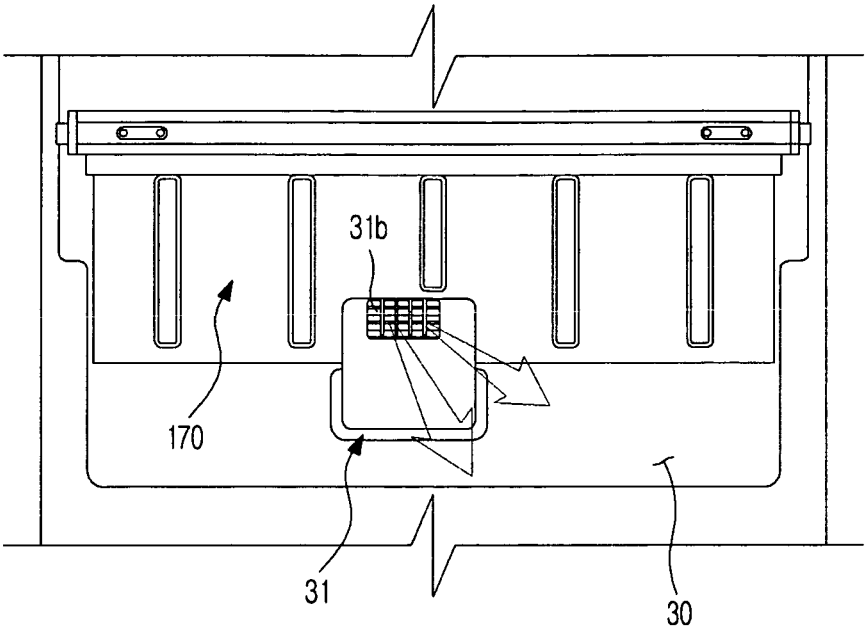
FIG. 7 is a view illustrating the top of the second storage compartment.
Figure 8:
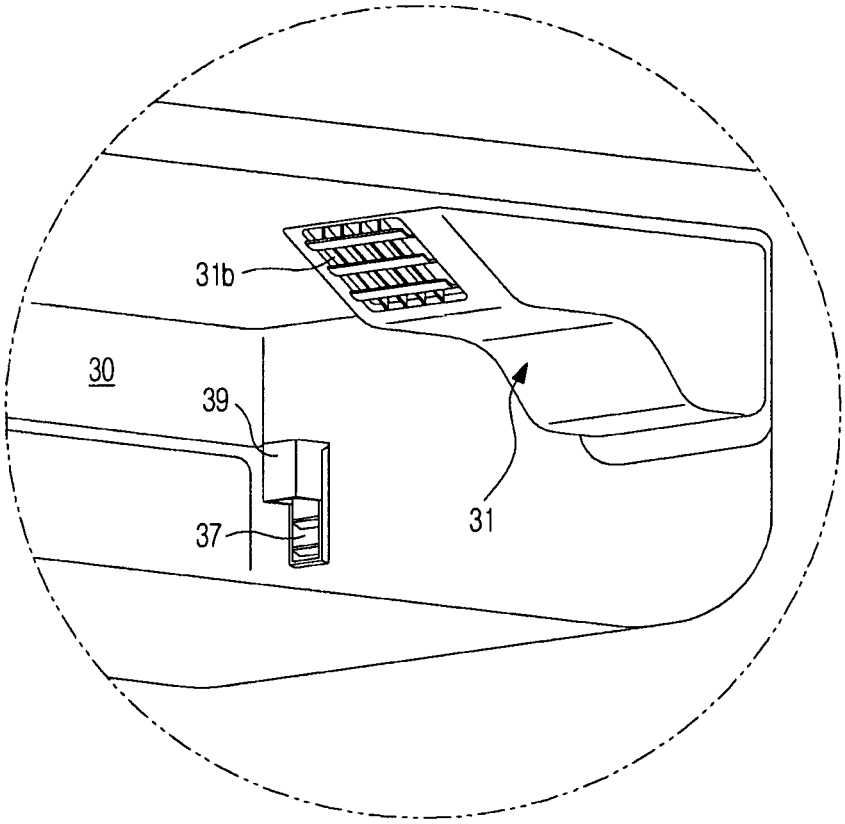
FIG. 8 is a perspective view illustrating the interior of the second storage compartment.
Figure 9:
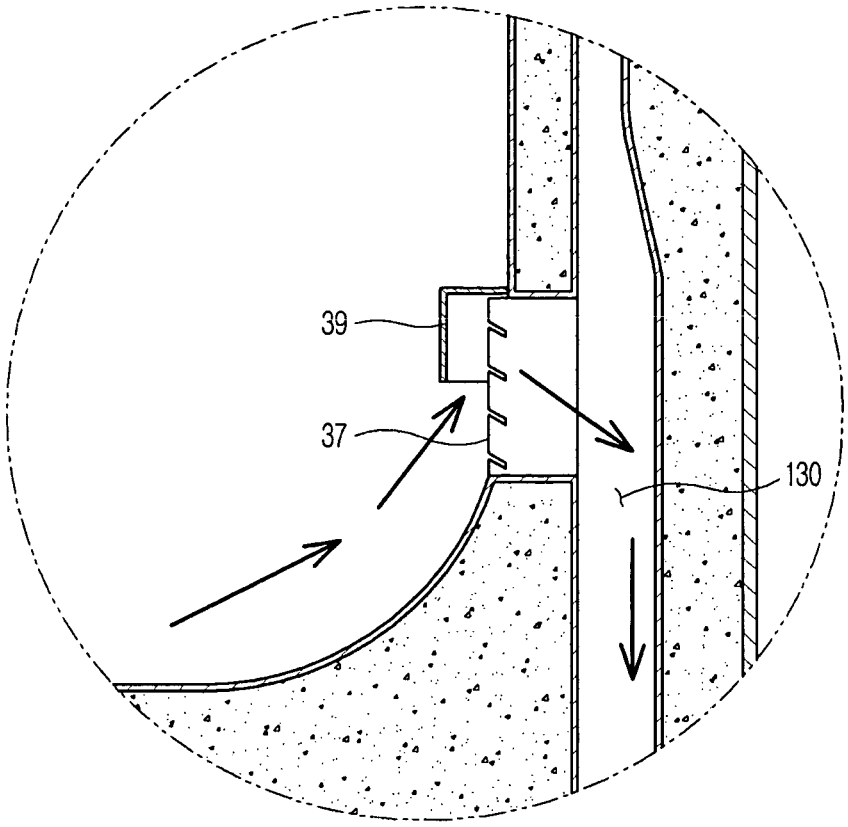
FIG. 9 is an enlarged sectional view illustrating a cold air inlet of the second storage compartment.

FIG. 6 is a sectional view of the second storage compartment. FIG. 7 is a view illustrating the top of the second storage compartment. FIG. 8 is a perspective view illustrating the interior of the second storage compartment. FIG. 9 is an enlarged sectional view illustrating the cold air inlet of the second storage compartment.

As shown in FIGS. 6 and 7, a curved section 170 is formed at the top of the second storage compartment 30. The curved section 170 includes a first curved portion 172 arranged at an entrance of the second storage compartment 30 while being downwardly protruded, a second curved portion 174 extending inwardly from the first curved portion 172 while being sharply inclined in an upward direction, and a third curved portion 176 extending inwardly from the second curved portion 174 while being gently inclined in a downward direction.

As the curved section 170 is formed at the top of the second storage compartment 30, it may be possible to uniformly distribute cold air in the second storage compartment 30. That is, it may be possible to solve problems incurred in the case in which the top of the second storage compartment 30 is planar, as in conventional cases, for example, rough flow of cold air and a phenomenon in which cold air discharged from the rear side of the second storage compartment 30 cannot reach the front side of the second storage compartment 30. In this regard, the curved section 170 functions as a cold air diffuser to diffuse cold air.

The first curved portion 172 defines a narrow space, in order to maximally prevent loss of cold air at the entrance of the second storage compartment 30. On the other hand, the second curved portion 174 and third curved portion 176 define a wide cold air flow space over a front portion of the second storage compartment 30, in order to allow cold air to flow smoothly such that the cold air reaches the front side of the second storage compartment 30. In conventional structures, it is difficult to supply cold air to the front side of the second storage compartment 30.

Referring to FIGS. 8 and 9, an introduction preventing cap 39 is arranged over the cold air inlet 37. The introduction preventing cap 39 functions to prevent cold air discharged out of the outlet 31*b* of the cold air discharge member 31 from being directly introduced into the cold air inlet 37 without circulating the interior of the second storage compartment 30. That is, the introduction preventing cap 39 enhances the internal energy efficiency of the second storage compartment 30.

The introduction preventing cap 39 is formed to surround an upper portion of the cold air inlet 37. Accordingly, the introduction preventing cap 39 prevents cold air from being introduced into the cold air inlet 37 through the upper portion of the cold air inlet 37, but allows cold air to be introduced into the cold air inlet 37 through a lower portion of the cold air inlet 37 after circulating the second storage compartment 30. Thus, only the cold air, which has a relatively high temperature, is selectively introduced into the cold air inlet 37 in accordance with the introduction preventing cap 39.

Hereinafter, operation of the refrigerator according to the illustrated embodiment will be described.

When the refrigerator operates in accordance with supply of electric power thereto, air present around the first and second evaporators 91 and 92 is cooled, so that cold air is generated. The cold air generated at the first evaporator 91 is supplied to the first storage compartment 20 via the first cold air supply passage 21*a*. The cold air is returned to the first evaporator 91 through the inlet 21*c* after circulating the first storage compartment 20. Thus, the cold air is repetitively circulated. Meanwhile, the cold air generated at the second evaporator 92 is partially supplied to the third storage compartment 40 via the second cold air supply passage 41*a*. This cold air is returned to the second evaporator 92 through the inlet 41*c* after circulating the third storage compartment 40. Thus, a portion of the cold air generated at the second evaporator 92 is repetitively circulated.

The remaining portion of the cold air generated at the second evaporator 92 is introduced into the cold air supply duct 110, and is then discharged into the second storage compartment 30 through the outlet 31*b* of the cold air discharge member 31. The discharged cold air is uniformly distributed in the second storage compartment 30 by virtue of the curved section 170 formed at the top of the second storage compartment 30. In this case, the cold air is supplied even to the front side of the second storage compartment 30. In conventional cases, it is difficult to supply cold air to the front side of the second storage compartment 30.

It may also be possible to achieve an enhancement in energy efficiency by virtue of the provision of the introduction preventing cap 39 because the cold air discharged out of the outlet 31*b* is introduced into the cold air inlet 37 after circulating the second storage compartment 30, without being directly introduced into the cold air inlet 37.

The cold air introduced into the cold air inlet 37 after circulating the second storage compartment 30 is moved to the second cold air supply passage 41*a* via the cold air return duct 130. During this movement, there is no dewing or frosting problem by virtue of the insulated partition wall 150 arranged between the cold air return duct 130 and the ice-making cold air return duct 76.

Hereinafter, another embodiment will be described with reference to the accompanying drawings. No description will be given of the same constituent elements as those of the previous embodiment of the present invention.

Figure 10:
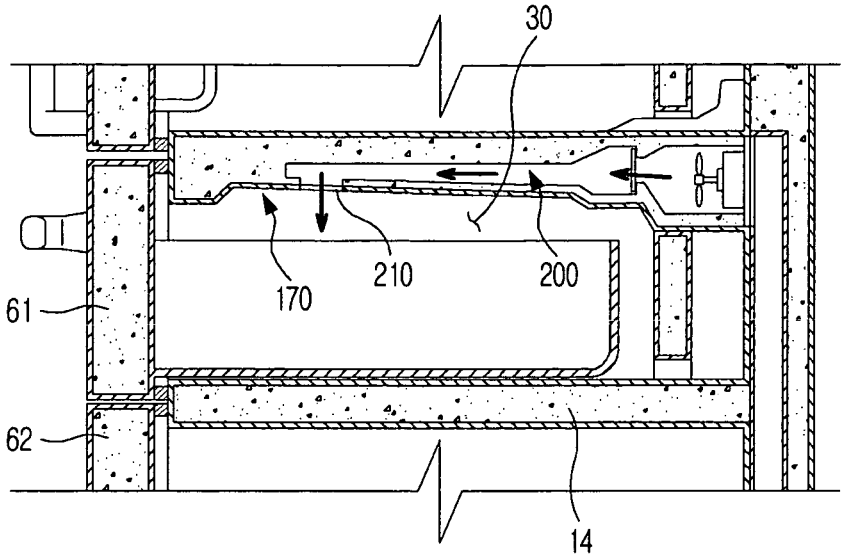
FIG. 10 is a sectional view of a second storage compartment according to another embodiment.
Figure 11:
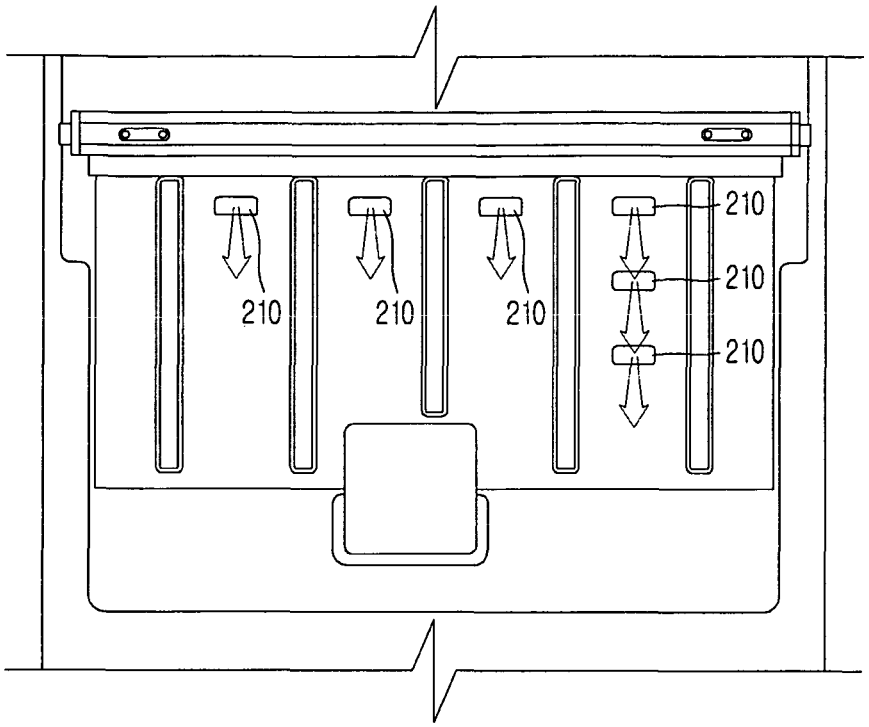
FIG. 11 is a view illustrating the top of the second storage compartment in the case of FIG. 10.
Figure 12:
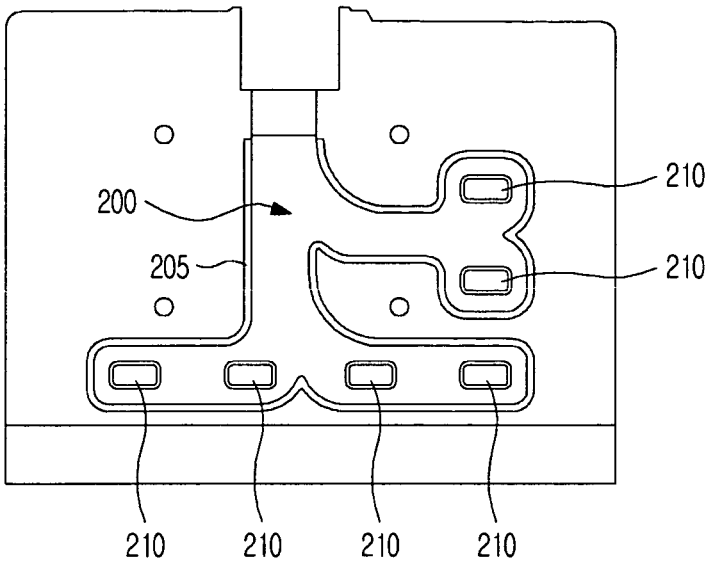
FIG. 12 is an enlarged view illustrating an internal flow passage formed in the top of the second storage compartment in the case of FIG. 10.

FIG. 10 is a sectional view of a second storage compartment according to another embodiment of the present invention. FIG. 11 is a view illustrating the top of the second storage compartment. FIG. 12 is an enlarged view illustrating an internal flow passage formed in the top of the second storage compartment.

As shown in FIGS. 10 to 12, the second storage compartment 30 includes a cold air diffusion passage 200 formed in a top wall of the second storage compartment 30. The cold air diffusion passage 200 has a structure capable of more uniformly distributing cold air in the second storage compartment 30. In conventional cases, cold air discharged from an outlet formed at the rear side of the second storage compartment 30 first comes into contact with food arranged near the outlet, and then flows to a portion of the second storage compartment 30 remote from the outlet. When the cold air reaches the second storage compartment portion remote from the outlet, it may have an excessively high temperature. To this end, the cold air diffusion passage 200 has a structure capable of effectively supplying cold air even to a second storage compartment region where cold air may not reach, while maintaining the cold air in a low temperature state.

The cold air diffusion passage 200 takes the form of a separate passage in the top wall of the second storage compartment 30. The cold air diffusion passage 200 communicates with the cold air supply duct 110.

The cold air diffusion passage 200 includes one or more cold air outlets 210 open to the second storage compartment 30. The cold air outlets 210 are holes formed to allow cold air moved along the cold air diffusion passage 200 to be finally discharged into the second storage compartment 30. The cold air outlets 210 are concentratedly arranged at the front side of the second storage compartment 30.

The cold air diffusion passage 200 is surrounded by an insulator 205, so as to be insulated from the surroundings. The insulator 205 may include at least one of an expanded polystyrene material and a urethane material.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a cabinet formed with an upper storage compartment, an intermediate storage compartment, and a lower storage compartment, which are partitioned from one another by insulated partition walls;

a first evaporator to supply cold air to the upper storage compartment;

a second evaporator to supply cold air to the lower storage compartment;

a cold air diffuser is disposed in the ceiling of the intermediate storage compartment;

a cold air supplier arranged beneath a rear wall of the upper storage compartment, to supply cold air to the intermediate storage compartment; and a cold air supply duct to supply cold air generated at the second evaporator to the cold air supplier;

wherein the cold air diffuser has a recessed structure to guide the cold air discharged through the cold air supplier, and a recessed front portion of the cold air diffuser is elevated relative to a recessed rear portion of the cold air diffuser.

2. The refrigerator according to claim 1, wherein:

the first evaporator is arranged at a rear side of the upper storage compartment; and the second evaporator is arranged at a rear side of the lower storage compartment.

3. The refrigerator according to claim 2, wherein the cold air supplier comprises a circulating fan to blow cold air to an outlet provided at a rear wall of the intermediate storage compartment, and a cold air regulator to regulate an amount of cold air to be supplied to the intermediate storage compartment.

4. The refrigerator according to claim 1, wherein the cold air diffuser comprises a first curved portion arranged at an entrance of the intermediate storage compartment while being downwardly protruded, a second curved portion extending inwardly from the first curved portion while being sharply inclined in an upward direction, and a third curved portion extending inwardly from the second curved portion while being inclined in a downward direction.

5. The refrigerator according to claim 2, further comprising:

an ice maker arranged in the upper storage compartment, to produce ice;

an ice-making cold air supply duct to supply cold air from the second evaporator to the ice maker; and an ice-making cold air return duct to return the cold air from the ice maker to the second evaporator, wherein the ice-making cold air return duct is integrally formed with a cold air return duct partitioned from the ice-making cold air return duct by an insulated partition wall, to return the cold air used to cool the intermediate storage compartment to the second evaporator.

6. The refrigerator according to claim 1, wherein the intermediate storage compartment comprises a cold air inlet arranged at one side of a rear wall of the intermediate storage compartment, to suck cold air used to cool the intermediate storage compartment such that the sucked cold air is returned to the second evaporator, and an introduction preventing cap arranged to cover an upper portion of the cold air inlet, the introduction preventing cap functioning to prevent cold air supplied to the intermediate storage compartment from being directly introduced into the cold air inlet.

7. The refrigerator according to claim 1, wherein the intermediate storage compartment comprises a cold air diffusion passage formed in a top wall of the intermediate storage compartment, to move cold air discharged through the cold air supply duct, and at least one cold air outlet formed at the cold air discharge passage, to discharge cold air into the intermediate storage compartment.

8. The refrigerator according to claim 7, wherein the at least one cold air outlet comprises cold air outlets concentratedly arranged near a front portion of the intermediate storage compartment.

9. A refrigerator comprising an upper storage compartment, an intermediate storage compartment, and a lower storage compartment, which are partitioned from one another by insulated partition walls, a first evaporator arranged at a rear side of the upper storage compartment, to supply cold air to the upper storage compartment, and a second evaporator arranged at a rear side of the lower storage compartment, to supply cold air to the lower storage compartment, further comprising:

a cold air diffuser is disposed in the ceiling of the intermediate storage compartment;

a cold air supplier comprising a cold air supply duct to supply cold air from the second evaporator to the intermediate storage compartment, a cold air return duct to return the cold air used to cool the intermediate storage compartment to the second evaporator, a circulating fan to discharge cold air supplied from the cold air supply duct into the intermediate storage compartment, and a cold air regulator to regulate an amount of cold air discharged into the intermediate storage compartment, wherein the cold air supplier is arranged beneath a rear wall of the upper storage compartment, to supply cold air to an outlet formed at one side of the intermediate storage compartment;

wherein the cold air diffuser has a recessed structure to guide the cold air discharged through the cold air supplier, and a recessed front portion of the cold air diffuser is elevated relative to a recessed rear portion of the cold air diffuser.

10. The refrigerator according to claim 9, wherein the intermediate storage compartment comprises a cold air inlet arranged at a rear side of the intermediate storage compartment, to suck cold air used to cool the intermediate storage compartment such that the sucked cold air is returned to the second evaporator, and an introduction preventing cap arranged to cover an upper portion of the cold air inlet, the introduction preventing cap functioning to prevent cold air discharged from the outlet from being directly introduced into the cold air inlet.

11. The refrigerator according to claim 9, further comprising:

an ice maker arranged in the upper storage compartment;

an ice-making cold air supply duct to supply cold air from the second evaporator to the ice maker; and an ice-making cold air return duct to return the cold air from the ice maker to the second evaporator, wherein the cold air return duct to return cold air used to cool the intermediate storage compartment is joined with the ice-making cold air return duct.

12. The refrigerator according to claim 11, wherein an insulated partition wall is arranged between the cold air return duct and the ice-making cold air return duct, to insulate the cold air return duct and the ice-making cold air return duct from each other.

13. The refrigerator according to claim 9, wherein the cold air diffuser comprises a first curved portion arranged at an entrance of the intermediate storage compartment while being downwardly protruded, a second curved portion extending inwardly from the first curved portion while being sharply inclined in an upward direction, and a third curved portion extending inwardly from the second curved portion while being inclined in a downward direction.

14. The refrigerator according to claim 9, wherein the intermediate storage compartment comprises a cold air diffusion passage formed in a top wall of the intermediate storage compartment, to guide cold air supplied through the cold air supplier such that the cold air is discharged through the outlet.

15. The refrigerator according to claim 14, wherein the intermediate storage compartment further comprises at least one cold air outlet formed through a top of the intermediate storage compartment, to communicate the cold air diffusion passage and the intermediate storage compartment.

16. The refrigerator according to claim 15, wherein the cold air diffusion passage is surrounded by an insulator.

17. A refrigerator comprising an upper storage compartment, an intermediate storage compartment, and a lower storage compartment, which are partitioned from one another by insulated partition walls, further comprising:

a first evaporator to supply cold air to the upper storage compartment;

a second evaporator arranged at a rear side of the lower storage compartment, to supply cold air to the lower storage compartment;

a cold air supply duct extending from the second evaporator to a rear side of the intermediate storage compartment, to supply cold air generated at the second evaporator to the intermediate storage compartment;

a cold air supplier arranged beneath a rear wall of the upper storage compartment, to supply cold air supplied from the cold air supply duct to the intermediate storage compartment; and a cold air diffuser formed at a top of the intermediate storage compartment, the cold air diffuser having a recessed structure to allow the cold air supplied through the cold air supplier to be diffused after reaching a front side of the intermediate storage compartment;

wherein the cold air diffuser is disposed in the ceiling of the intermediate compartment, wherein the cold air diffuser has a recessed structure to guide the cold air discharged through the cold air supplier, and a recessed front portion of the cold air diffuser is elevated relative to a recessed rear portion of the cold air diffuser.

18. The refrigerator according to claim 17, wherein the cold air diffuser comprises a first curved portion arranged at an entrance of the intermediate storage compartment while being downwardly protruded, a second curved portion extending inwardly from the first curved portion while being sharply inclined in an upward direction, and a third curved portion extending inwardly from the second curved portion while being inclined in a downward direction.

19. The refrigerator according to claim 17, further comprising:

a cold air return duct to return cold air from the intermediate storage compartment; and an ice-making cold air return duct to return cold air from an ice maker, which produces ice, wherein the cold air return duct is joined with the ice-making cold air return duct, and an insulated partition wall is arranged between the cold air return duct and the ice-making cold air return duct, to insulate the cold air return duct and the ice-making cold air return duct from each other.

20. The refrigerator according to claim 17, wherein the intermediate storage compartment comprises:

a cold air inlet arranged at one side of a rear portion of the intermediate storage compartment, to suck cold air from the intermediate storage compartment, the cold air inlet communicating with the cold air return duct; and an introduction preventing cap arranged to cover an upper portion of the cold air inlet, the introduction preventing cap functioning to prevent cold air discharged into the intermediate storage compartment from being directly introduced into the cold air inlet.

21. The refrigerator according to claim 1, wherein the cold air supplier is disposed on the same plane as the cold air diffuser.

22. The refrigerator according to claim 9, wherein the cold air supplier is disposed on the same plane as the cold air diffuser.

23. The refrigerator according to claim 17, wherein the cold air supplier is disposed on the same plane as the cold air diffuser.

24. A refrigerator comprising:

a cabinet having a drawer-type storage compartment;

an evaporator to supply cold air to the drawer-type storage compartment; and an insulated partition wall including curved portions to form a raised ceiling section of the drawer-type storage compartment; and a cold air outlet to introduce cold air from the evaporator into the drawer-type storage compartment, wherein the cold air diffuser has a recessed structure to guide the cold air discharged through the cold air supplier, and a recessed front portion of the cold air diffuser is elevated relative to a recessed rear portion of the cold air diffuser.

25. The refrigerator according to claim 24, wherein the cold air outlet is disposed at one of the curved portions forming the raised ceiling section.

* * * * *